United States Patent [19]

Kramer

[11] 4,037,427

[45] July 26, 1977

[54] REFRIGERATION EVAPORATORS WITH ICE DETECTORS

[76] Inventor: Doris S. Kramer, 2009 Woodland Drive, Yardley, Pa. 19067

[21] Appl. No.: 500,309

[22] Filed: Aug. 26, 1974

Related U.S. Application Data

[63] Continuation-in-part of Ser. No. 142,694, May 21, 1971, abandoned, and Ser. No. 373,456, June 25, 1973, abandoned.

[51] Int. Cl.[2] ..... F25D 21/04

[52] U.S. Cl. ..... 62/128; 62/140; 340/234

[58] Field of Search ..... 62/140, 128, 150, 285; 137/392; 73/295; 340/244, 234

[56] References Cited

U.S. PATENT DOCUMENTS

| | | | |
|---|---|---|---|
| 2,071,148 | 2/1937 | Weisberg et al. | 340/234 |
| 2,269,019 | 1/1942 | Hall | 340/234 |
| 2,505,201 | 4/1950 | Peterson | 62/140 |
| 3,224,216 | 12/1965 | Crouch | 62/285 X |
| 3,285,275 | 11/1966 | Couffer, Jr. et al. | 137/392 |
| 3,358,467 | 12/1967 | Hickox et al. | 62/285 X |

FOREIGN PATENT DOCUMENTS

| | | | |
|---|---|---|---|
| 635,767 | 1/1962 | United Kingdom | 62/140 |

*Primary Examiner*—William E. Wayner
*Attorney, Agent, or Firm*—Daniel E. Kramer

[57] ABSTRACT

A refrigeration evaporator with a drain pan which contains a heated temperature sensitive element for distinguishing between the abnormal condition of water or ice in the drain pan and the normal condition of cold air there. The distinguishing action of the element takes place because the heated element is warmer in the presence of air than in the presence of moisture. An alarm or signal, for alerting operating or service personnel, responds to the temperature of the sensor.

4 Claims, 6 Drawing Figures

REFRIGERATION EVAPORATORS WITH ICE DETECTORS

BACKGROUND OF THE INVENTION

1. Field of the Invention

This invention is in the field of refrigeration evaporators with drain pans including means for detecting accumulated water or ice therein. The term "moisture" as used in this specification and claims means "water" or "ice" or "water and ice".

2. Description of the Prior Art

The process of cooling air frequently results in the condensation of water from the air onto the cooling surface. Where the coolant is above the freezing point of water, the water deposits on the cooling surface as liquid. The water flows by gravity from the cooling surface into a pan provided under the surface and out of the pan into an outlet fitting connected to the pan at its lowest point. The outlet fitting is usually connected to a pipe which conveys the water to sewer or drain.

Where the cooling surface has a temperature below 32° F, the freezing point of water, frost accumulates on it by a process which is the reverse of sublimation, proceeding from water in the vapor state to water in the solid state; known as frost in the fluffy as-deposited condition, and as ice in its dense thawed-and-frozen condition; without traversing the liquid state. The cooling surface is most generally a finned coil, although a plate coil or bare tube coil can be used. Over a period of cooling operation enough frost can, and frequently does, accumulate to block air passages through the cooling coil. When the air passages in the coil are blocked by frost, the effectiveness of the coil for the purpose of cooling air is sharply reduced. At or before this time, it is generally desirable to defrost the surface, restoring the air passages to their original, unfrosted condition. The source of heat for defrost may be from electric heaters or from hot gas. The means for defrosting are well-known to those skilled in the refrigeration art and are exemplified by matter shown in U.S. Pat. Nos. 2,718,764 and 3,464,226. The water resulting from the thawing of the frost on the coil runs into a pan provided for this purpose and is conveyed to a sewer via a drain fitting and drain line.

The drain line from the drain pan to the sewer frequently traverses a cold area and therefore must be heated to prevent the meltage from re-freezing. Should the drain line be blocked, by ice, through failure of the heater; by dirt, or any other way; meltage will collect in the drain pan and may freeze on termination of the defrost and resumption of the refrigeration cycle. As additional meltage from each successive defrost operation collects and freezes, a large accumulation of ice in the drain pan and around the coil may occur. Occurrences of this sort in frozen food display cases and in cooling coils used in bakeries and food processing plants are frequent, primarily because of dirt accumulation which blocks the drain, combined with poor maintenance. Thawing out a completely iced-up evaporator in a freezer box or display case is a time-consuming and expensive job for a serviceman and inevitably results in much mess and lost sales in the store using the display case, or lost production time where the evaporator is used for cooling or freezing products. It is apparent that the use of floats or mechanical devices to detect water or ice where the temperature is below 32° F, the freezing point of water, will not be effective.

SUMMARY OF THE INVENTION

A defrosting refrigeration evaporator with a drain pan which includes a simple, non-mechanical system for positively detecting water or ice collected therein. The system employs a heated temperature sensing element located within the pan or its outlet connection. The temperature of the element is high when in air. When the element is contacted by water or ice, its temperature is sharply lowered. The change in the temperature of the element activates a signalling device. In its most general form, the invention comprises an evaporator for use within a freezing environment with a drain pan, and heated element within the pan which will be at a higher temperature when surrounded by air and at a lower temperature when surrounded by water, and means outside the pan for providing indication when the temperature of the sensor traverses a predetermined temperature between the higher and the lower.

DESCRIPTION OF THE PREFERRED EMBODIMENT

Figure 1:
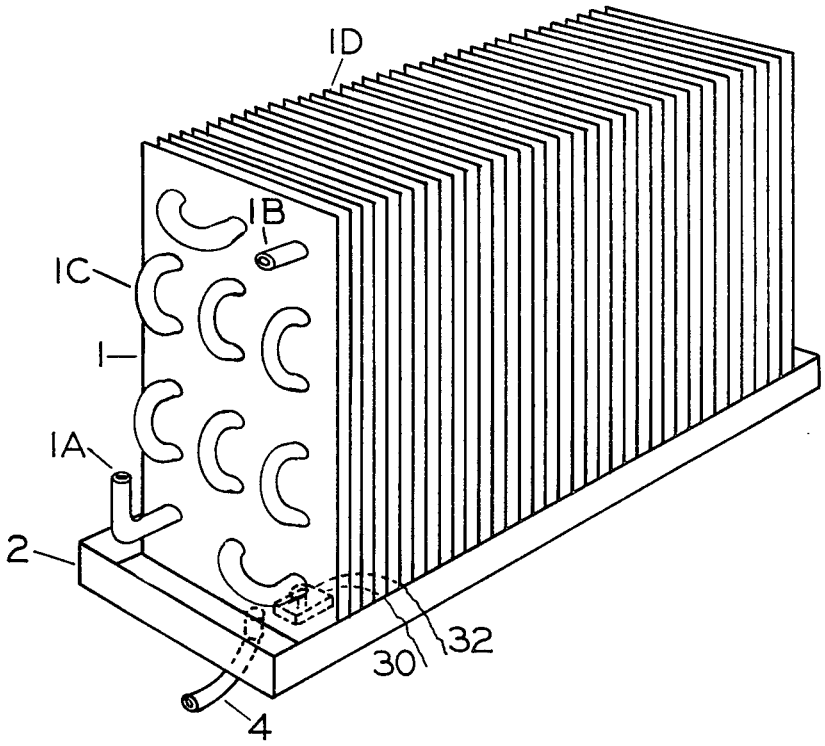
FIG. 1 shows a finned cooling coil and associated drain pan of a defrosting refrigeration evaporator, where the installed heated element or sensor is hidden by the coil and shown dotted.
Figure 2:
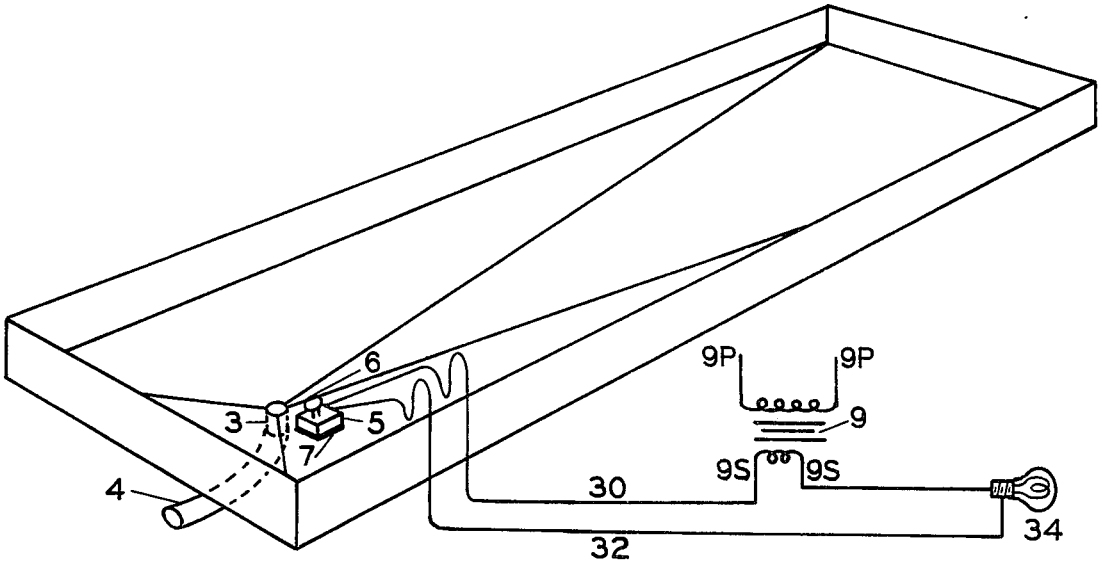
FIG. 2 shows the drain pan of FIG. 1 with coil 1 removed, exposing the heated element, an electrical circuit, and a bulb which lights when moisture surrounds the element.
Figure 3:
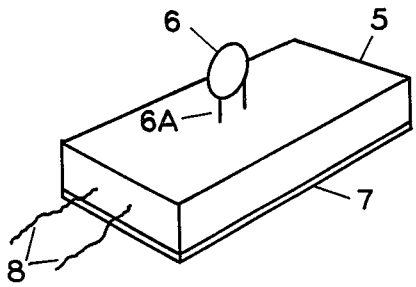
FIG. 3 shows the heated element mounted by its wire leads to an adhesive-coated mount.
Figure 4:
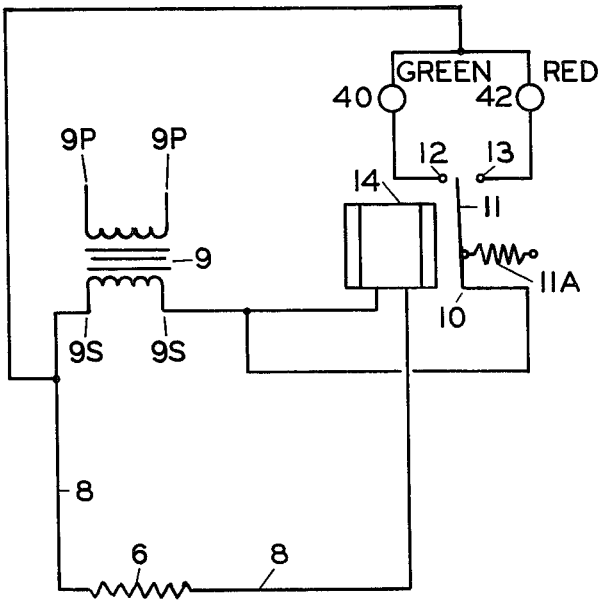
FIG. 4 is a schematic diagram of an electric circuit which includes the element and a relay with energized and de-energized conditions, where the relay changes its condition on a change of the element environment from air to moisture.
Figure 5:
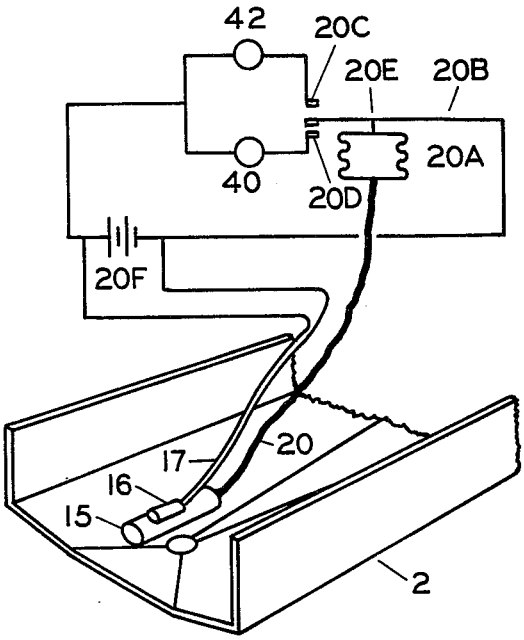
FIG. 5 shows a drain pan containing the moisture detector where the temperature sensing element is not the heater but is a thermostat mounted in thermal connection to it.
Figure 6:
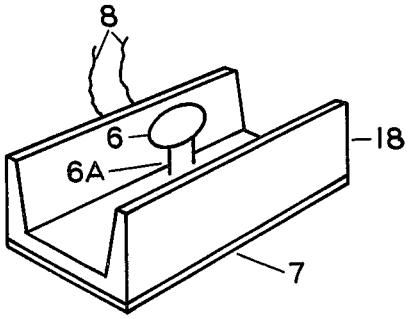
FIG. 6 shows a moisture detector similar to that shown in FIG. 3 with the sides of the mount upraised to protect the element.

FIG. 1 shows cooling coil 1, including fins 1D, traversed by for cooling the coil and defrosting it refrigerant conducting tubes connected at the ends by U bends 1C with refrigerant inlet 1A and refrigerant outlet 1B, with drain pan 2 mounted immediately beneath. Drain pan 2 has outlet 3 hidden by coil 1 and outlet tube 4 connected to the outlet 3. The cooling element 1, through connection of its refrigerant inlet 1A and outlet 1B to refrigeration means not shown, cools air and causes deposition on it of moisture in the form of frost. The refrigeration means may be of the type shown in U.S. Pats. Nos. 2,718,764 or 3,464,226, or any other type. The combination of coil and drain pan is known as a refrigeration evaporator. Motor-driven fans for moving the air to be cooled through the coil are sometimes supplied but their presence or absence do not form part of the invention. Shown dotted in FIG. 1, attached to the interior of the bottom of drain pan 2, is a sensor comprising a heated element for the purpose of determining the condition of the environment surrounding the sensor. Wires 30 and 32, which are shown leaving drain pan 2, are connected to the sensor. FIG. 2 shows the drain pan 2 of FIG. 1, but with the cooling element 1 removed, disclosing sensing element 6 connected by its wires to mount 5, which is attached to the interior of the bottom of drain pan 2 by way of adhesive layer 7. Two wires 30 and 32, embedded in mount 5, are connected to and extensions of the wires of the sensor 6 and are extended outside the drain pan. Wires 30 and 32 are connected to a circuit comprising transformer 9, which utilizes a primary winding with primary connections 9P for connection to a source of alternating current power and secondary winding with connections 9S, which provides the low voltage for actuation of the sensor 6 and the indicating element light bulb 34. Element 6 is a resistor of a special type whose resistance varies sharply in accordance with its temperature. Special resistances of this type are known to those skilled in the electronic art as thermistors, though any resistor whose resistance changes predictably with temperature can be used. Thermistors may be of a type whose resistance increases with increase in temperature, known as having a positive temperature coefficient (PTC), or the type whose resistance decreases with temperature, known as having a negative temperature coefficient (NTC). In this case, element 6 is a PTC thermistor whose resistance rises sharply as its temperature increases. Under normal conditions, the drain pan 2 is empty and sensor 6 is immersed in air. The current induced by the transformer 9 to flow through the element (6) by way of its connecting wires 30 and 32 causes the element 6 to heat. Despite the possible rapid flow of cold air induced by a fan, not shown, over element 6, the low heat transfer coefficient between the air and the element 6 allows the element 6 to become warm, attaining a temperature, for example 100–200° F, despite the air temperature around the sensor being in the range of −40° to +40° F. With the sensor temperature in this range, its resistance is sufficiently high, for instance 200 ohms or greater, that the flow of current through it is reduced to the point where bulb 34 is not lit. Should the drain fitting 3 or outlet pipe 4 plug for any reason and fail to allow meltage to flow from drain pan 2, the meltage will accumulate in the drain pan 2 and, through successive defrosts will soon cover sensing element 6. When this occurs, the superior cooling effect of the water or the ice in direct contact with the element 6 will serve to convey from it the small amount of heat generated in it by the flow of the electricity through its connecting wires 30 and 32. At this time, the temperature of the element 6 will be reduced to approximately the same temperature as the moisture, in the range of −40° F to +40° F. The element 6 will, under this temperature condition, have a low electrical resistance, for instance, 70 ohms, and therefore, will allow a substantial current flow through its connecting wires 30 and 32 sufficient to cause indicating bulb 34 to light, providing a warning to owning or operating personnel of the flooding or icing condition just beginning to occur, and as yet unseen externally, in the bottom of drain pan 2. In the circuit of FIG. 2, a 2 watt, 12 volt lamp 34 requires for rated brightness a current flow of 0.17 amperes. For a voltage of 24 at transformer secondary leads 9S the resistance of element 6 when cold (immersed in moisture) will be 72 ohms to allow this current flow. For bulb 34 to be essentially extinguished (light output = 2% of rated) the current flow through it must be less than 50% of rated or 0.085 amperes. To achieve this reduced current flow when element 6 is immersed in air, its resistance must increase to a value over 200 ohms when hot. The resistance of the bulb when cold (current equals zero) is only about 27% of its resistance at rated current. Resistance of the bulb at 50% of rated current is about 43% of its resistance at rated current. These values are given for illustration and it is not intended to limit the invention to elements having resistances in these ranges. FIG. 3 shows an enlarged detail of one design of a mount for sensor 6. The sensor 6 which in FIG. 3 is a thermistor, but which may also be any other kind of resistor whose resistance is temperature related, is mounted by its wires 6A to mount 5, which is of molded plastic. The lead wires 8 for connection to the electrical circuit are connected to lead wires 6 and molded into mount 5. The mount 5 has an adhesive preparation 7 attached to one side to allow secure attachment of the assembly to the interior of the drain pan without the need for drilling any holes. FIG. 4 shows an electric circuit including sensor 6 where the power for actuation of the sensor 6 and its related relay 14 is provided by transformer 9, the primary leads of which (9P) are intended to be connected to a source of alternating current such as 115 volt domestic lighting circuit, and the secondary of which, terminating in leads 9S, is designed to produce an output voltage desirably between 6 and 30 volts for actuation of the circuit. When the sensor 6 is immersed in air, the heating effect of the current through it, combined with the relatively poor cooling effect of the air circulating around it, allows the sensor temperature to rise, for example over 100° F. At this condition, a sensor with a negative coefficient of resistance (NTC) change will have a low resistance, for instance 72 ohms, allowing substantial current to flow, sufficient for coil 14 to attract the iron armature 11 against the tension of spring 11A, causing the armature to contact and mate with the electrical contact 12, closing the circuit between 10 and 12. The closing of this circuit allows current to flow to lamp 40, which is colored green, to inform the observer that the drain pan is free of water and ice. Should the drain pan become flooded with water or ice, sensor 6 would be chilled to a temperature approaching that of the water or ice, for instance, −40° to +40°, and, under this condition, would exhibit a higher resistance, for instance, 1000 ohms, which would reduce the current flow through a relay coil 14. Because of the reduced magnetic effect of coil 14, armature 11 is retracted by spring 11A to a position where the armature touches and makes contact with point 13, completing the circuit between 10 and 13, and allowing current flow to occur through lamp 42, which is colored red, for the purpose of warning the observer that an incipient icing condition has occurred in the drain pan and that immediate attention is required to correct t his condition and its cause. For increased simplicity, contact 12 and lamp 40 could be omitted, so that no light wou ld be lit if the drain pan were in normal operating condition. The red light 42 only would be energized should drain pan icing or flooding occur. Sensor 6 could be a positive temperature coefficient resistance (PTC) or thermistor that is, one whose resistance increases with an increase in temperature. In that event, when the thermistor was immersed in air and its temperature was high, its resistance also would be high, for example, 1000 ohms, and relay coil (14) would be insufficiently energized to attract armature (11). In that case, light 42 would be lit whose bulb would now be colored green to denote a satisfactory operating condition. When the sensor 6 is surrounded by water or ice and cooled to a temperature between −40° and +40° F, its resistance will be very low on the order of 72 ohms, allowing sufficient current to flow through relay coil 14 to generate sufficient magnetic flux to attract clapper 11 and make the contact between 10 and 12, allowing electricity to flow through lamp 40, which would now be colored red to warn of an impending icing situation in the drain pan in which the sensor 6 was located. FIG. 5 shows a section of drain pan 2 in which a bulb 15 of a thermostat is placed. Heater 16 is thermally attached to the bulb 15. Wires 17 provide electrical power to the heater 16, which continuously heats the bulb 15. When the bulb 15 is immersed in air, its temperature is high, for instance, 100° F, even though the air circulating around it may be within the temperature range of −40 to +40° F. Should the drain outlet become plugged with ice or other material, which prevents the outflow of meltage resulting from the defrost of coil 1, the level of moisture in drain pan 2 will rise until the bulb 15 of the thermostat is partially or fully covered. At that time, bulb 15 will be cooled to a level approaching the temperature of the surrounding moisture, which will be in the region of −40°to +40° F. The thermostat switch, comprising parts 20B, 20C, 20D and 20E, is actuated by bellows 20A, which is connected to the temperature sensing bulb 15 by capillary tube 20, and is set to break connection with contact 20C and make connection with contact 20D when the temperature of bulb (15) falls below approximately 70°, though any setting between the temperature of bulb 15, when immersed in air and its temperature when immersed in moisture, would be satisfactory. When the bulb 15 is cold, because it is immersed in moisture. thermostat bellows 20A contracts, bringing armature 20E into electrical contact with point 20D, allowing current flow to bulb 40, which is colored red to warn of an impending flooding or icing condition, and stopping current flow to bulb 42. Light bulb 42 will be lit when thermostat bulb 15 is above the switch setting, indicating to the observer that there is no water or ice surrounding the thermostat bulb 15 and that the drain pan is clear. FIG. 6 shows an enlarged detail of sensor 6 mounted by its wires 6A to a mount which is formed with up-rising side walls 18 for the purpose of providing mechanical protection to the sensor (6) and to its relatively fragile mounting wires 6A. Other means of mounting the sensor 6 than by its wires 6A are possible, but the mounting means employed must be of high thermal resistance so that the small amount of heat generated by the current flow through the sensor 6 is not dissipated to the mount during those periods when the sensor 6 is surrounded by air. In this way, the sensor 6, when surrounded by air, will reach its maximum temperature and, therefore, show the sharpest temperature drop when immersed in water or ice for the clearest indication of the difference between the two conditions. FIG. 6 also shows lead wires 8 which are connected within the mounting block to the sensor mounting wires 6A. An adhesive pad 7 is attached to the bottom of the mount for convenient attachment to the interior of any drain pan without the need for drilling holes with a subsequent need for sealing any mounting screw hole against the leakage of water.

I claim:

1. Improved refrigeration evaporator means for use within a freezing environment comprising in combination an element for cooling air and condensing moisture from the air, drain pan means mounted under the element for receiving only said moisture said pan means having an outlet for discharging the moisture to a drain; wherein the improvement comprises: continuously self-heated resistor sensing means mounted within the drain pan means, said sensing means having a higher temperature in the presence of air and a lower temperature in the presence of ice; and indicating means mounted without the drain pan means for indicating a change from the higher to the lower temperature.

2. Improved evaporator means, as in Claim 1, including a mount, one side of which has an adhesive coating for attaching the sensing means to the interior of the drain pan, where the sensing means is attached to the mount.

3. Improved refrigeration evaporator means for use within a freezing environment, said means having an element for cooling air and condensing moisture from the air, a drain pan under the element for receiving only said moisture, wherein the improvement comprises: ice detector means, said detector means having continuously self-heated resistor sensor means mounted within the drain pan, said means having a higher temperature when immersed in the air and a lower temperature when immersed in ice and indicator means without the pan, for responding to the temperature of the sensor and for providing indication when the sensor cools from the higher to the lower temperature.

4. The method of distinguishing between the presence of air and ice within the drain pan of a refrigeration evaporator intended for use within a freezing environment, comprising the steps of:

Providing in the drain pan a continuously self-heated resistor sensor having a higher temperature when in contact with air and a lower temperature when in contact with ice.

B. Selecting a temperature between said higher and lower temperature.

C. Sensing the temperature of the sensor.

D. Comparing the temperature of the sensor with the pre-selected temperature.

E. Indicating outside the pan whether the temperature of the sensor is above or below the pre-determined temperature.

* * * * *